US005441773A

United States Patent [19]

Rodzewich

[11] Patent Number: 5,441,773

[45] Date of Patent: Aug. 15, 1995

[54] COMPOSITION AND METHOD OF FORMING A BLACK NO-RINSE CONVERSION COATING ON METAL SURFACES

[75] Inventor: Edward A. Rodzewich, Flourtown, Pa.

[73] Assignee: Betz Laboratories, Inc., Trevose, Pa.

[21] Appl. No.: 295,309

[22] Filed: Aug. 24, 1994

Related U.S. Application Data

[63] Continuation-in-part of Ser. No. 109,115, Aug. 19, 1993, which is a continuation-in-part of Ser. No. 823,216, Jan. 21, 1992, abandoned.

[51] Int. Cl.[6] ..... B05D 3/02

[52] U.S. Cl. ..... 427/388.4; 427/388.1; 524/431

[58] Field of Search ..... 427/156, 287, 388.1, 427/385.5, 388.4; 134/2–7; 156/628; 524/431

[56] References Cited

U.S. PATENT DOCUMENTS 4,636,264 1/1987 Schellenberg et al. ..... 148/6.2
4,755,434 7/1988 Fujii et al. ..... 427/409
4,755,435 7/1988 Fujii et al. ..... 427/202
4,931,317 6/1990 Shima et al. ..... 427/385.5
5,006,597 4/1991 Luecke et al. ..... 524/556

FOREIGN PATENT DOCUMENTS 2739576 5/1978 Germany .
81033155 4/1981 Japan .

*Primary Examiner*—Shrive Beck
*Assistant Examiner*—Fred J. Parker
*Attorney, Agent, or Firm*—Alexander D. Ricci; Steven D. Boyd

[57] ABSTRACT

A black, no-rinse conversion coating on metal surfaces is provided. The treatment of a metal such as aluminum or aluminum alloys with a composition of hexavalent chromium, a modified styrene acrylic resin, carbon black thickeners, surfactants and coalescents results in a black no-rinse conversion coating. The black coating provides corrosion resistance and is resistant to gasoline, hot oil and ethylene glycol. The coating solution is particularly effective on complex shapes having closely spaced parts such as automotive radiators or condensers.

1 Claim, No Drawings

COMPOSITION AND METHOD OF FORMING A BLACK NO-RINSE CONVERSION COATING ON METAL SURFACES

This application is a continuation-in-part of application Ser. No. 08/109,115 filed Aug. 19, 1993 which is a continuation-in-part of application Ser. No. 07/823,216 filed Jan. 21, 1992, now abandoned.

FIELD OF THE INVENTION

The present invention relates to a method and composition for the formation of a black conversion coating on metal surfaces. More particularly, the present invention relates to a method and composition for the formation of a black no-rinse conversion coating on metals such as aluminum and its alloys. The process has been found to be particularly effective at forming a corrosion resistant black coating on aluminum surfaces in a single step no-rinse operation.

BACKGROUND OF THE INVENTION

Methods for the formation of black films or coatings on the surfaces on various metal are currently available. The methods vary with the particular type of metal, e.g., ferrous metals, stainless steels, zinc and its alloys, aluminum and its alloys, copper and its alloys. The composition of the treatment solution and the treatments conditions vary from case to case. Japanese Patent Publication No. 56-33155 (33155/81) in the name of Nihon Parkerising Company, Ltd. discloses a method of forming a black coating on the surface of aluminum and aluminum alloys by coating with an aqueous resin containing solution followed by baking to produce a coating of the desired weight. The aqueous solution contains a hexavalent chromium compound, a reducing agent and water soluble resin.

In the treating of many aluminum or aluminum alloy articles the more common procedure is to first apply a conversion coating such as a chromium based coating and thereafter to apply a solvent based black paint. The first step creates a corrosion resistant conversion coating. The second painting step is almost exclusively a decorative and aesthetic step. Such two step processes require extra equipment and waste disposal procedures. Coatings such as described in Japanese Patent Publication Number 56-33155 also require ovens to bake the coated metal to form the coating thereon.

Similarly, U.S. Pat. No. 4,931,317 discloses a method and composition for the formation of a black film or coating on the surface of various materials by coating and subsequent baking of a treatment solution containing ferrous metal ions, hexavalent chromium, trivalent chromium and a film forming polymer dissolved or dispersed in water. The black nature of the coating is due to the steric structure of a complex cross-linked-bonded matrix formed by a reaction mechanism which includes polymer, trivalent chromium and Fr, Co or Ni atoms. The presence of trivalent chromium gives rise to stability problems in the coating solution.

SUMMARY OF THE INVENTION

It has been found that a single step, black, no-rinse conversion coating can be formed on aluminum and aluminum alloys by the composition and methods of the present invention. The composition and methods of the present invention are directed to a chromium based conversion coating in conjunction with a modified styrene acrylic resin/latex emulsion and a carbon black pigment. It was discovered that a coating solution comprising a hexavalent chromium in conjunction with a styrene acrylic resin/latex emulsion and a black pigment would form a single step, no rinse, black, conversion coating on aluminum and aluminum alloys. The black coating does not require any baking operation and no ferrous metal ions such as Fe, Co or Ni are required. However, forced drying as in an oven may be used to decrease processing time. The black coating can be applied by spraying, immersion, draw bar, flow coating or roll coating. The resulting black coating is an adhering, flexible corrosion resistant film.

The coating of the present invention is particularly effective on complex shaped articles such as automotive condensers or radiators. The combination of surfactant, thickeners and coalescents of the present invention provides a stable treatment solution which will coat complex shapes such as an automotive radiator without bridging between closely spaced elements. Further, the black coating of the present invention provides corrosion control as well as being resistant to damage by gasoline, hot oil and ethylene glycol. The black coating meets or exceeds the requirements of Ford Engineering Materials Specification EST-M62J18-A.

DESCRIPTION OF THE PREFERRED EMBODIMENT

It has been found that a black, conversion coating can be formed on complex shapes of aluminum and its alloys in a single no-rinse step. The black coating of the present invention is formed by applying a coating solution to a clean aluminum or aluminum alloy surface. The coating solution may be applied in any conventional manner such as spray, immersion, or roll coating. The coating solution is allowed to dry in place after application forming a black, conversion coating thereon.

The coating solution of the present invention comprises from about 0.01 to 0.20% an aqueous solution of hexavalent chromium in conjunction with from about 2.0 to 10% (as solids) a modified styrene acrylic resin emulsion and from about 0.5 to 3% a carbon black pigment (all concentrations herein are stated in weight percent unless otherwise noted). By modified it is meant that the resin has carboxylated functionality in contrast to hydroxyl or no functionality. The pH of the coating solution should be below 7 and is preferably between 3 and 5. It is believed that the corrosion resistant conversion coating is formed during the drying step. The chromium is present initially as hexavalent chromium in the coating solution. As the applied wet coating solution dries, the hexavalent chromium reacts with the aluminum surface where it is reduced to trivalent chromium. This reaction leads to the formation of the conversion coating. It is also believed that the trivalent chromium destabilizes the resin present in the coating solution causing the deposition of an insoluble film on the metal surface. Thus, no trivalent chromium can be present in the treatment solution or instability would result. No ferrous metal ions such as Fe, Co or Ni are present in the coating solution. The presence of carbon black in the resin emulsion results in a black conversion coating being formed.

It was found that the pigment, preferably carbon black, is more easily dispersed in a resin emulsion then in a resin solution. Also, such resin emulsions have been found to exhibit better film forming characteristics. Such action is preferable when treating complex shapes such as automotive radiators or condensers. It was found that the preferred color and stability in the coating composition was provided by a non-ionic dispersion of carbon black. The preferred resin of the present invention is a modified styrene acrylic copolymer emulsion.

The coating composition of the present invention includes thickeners such as gums and other swelling polymers to modify the solution viscosity. Such thickeners are employed to assist in applying the solution to the metal articles being treated. The use of thickeners allows a black dried in place conversion coating to be formed from solutions having a reduced solids content. In order to provide adequate "film build" to give a black coating while still being able to coat complex or closely spaced shapes, the viscosity of the treatment solution is controlled by thickeners to between 300 and 700, preferably between 450–500 cps (Brookfield).

For economic reasons it may be desirable, in certain situations, to reduce the level of latex emulsion in the coating solution. As the latex level is reduced, drainage time decreases and the resultant film becomes thinner. This thinning of the film results in a streaking, brown-black appearance. In addition, emulsion polymers do not possess an intrinsic ability to wet pigments. Consequently as the solids level is lowered, a poor wetting situation can develop as evidenced by carbon black destabilization in the dried coating. This is controlled by the addition of a suitable surfactant or dispersant which serves to stabilize the carbon black in the emulsion polymer. The surfactant selected must be compatible with the thickener. It was found that nonionic surfactants are preferred.

The selection of a suitable carbon black dispersion is based in part on the conditions of operation and the desired end results. Commercial aqueous carbon black dispersions are available which differ in degree of jetness, pigment level, type of dispersing agent (anionic/-cationic), pH and conductivity. It was found that anionic dispersed carbon blacks were unstable in latex emulsion systems at pH below 7.0 which contain cations such as chromic acid and aluminum. Accordingly, in a hexavalent chromic acid treatment for aluminum, non-ionic carbon black dispersions are preferred.

Coalescents are added to the coating bath to improve the flow of the bath over the part being coating and also to improve film uniformity. Fast and slow evaporating type coalescents were tested and slow evaporating coalescents such as Texanol® (a 2,2,4 trimethyl pentane 1,3 diol mono-isobutyrate available; from Eastman Chemical Products Inc., of Kingsport, Tenn.) were found to provide the best film in the preferred coating bath of the present invention. The coalescents are materials which can be absorbed by the resin and cause it to swell. The preferred slow evaporating coalescents remain after water has dried from the coating to inhibit cracking of the coating as the coalescents slowly evaporate.

In situations where economics make a low solids coating bath desirable, wetting and dispersing agents are employed to solubilize the coalescents and for forming a continuous coating. Anionic surfactants and dispersants tend to destabilize a carbon black-emulsion mixture which results in a diphase separation in the coating bath and a particulate build-up in both the bath and the coating itself. Non-ionic surfactants were found to be best suited for use in the preferred chromic acid based coating bath for aluminum of the present invention.

In a low solids formulation, thickening agents compatible with the coating bath must be selected. Acrylic based thickener function only in alkaline conditions. Hydroxy celluloses will thicken a low solids acid formulation but were found to produce poor wetting and film formation. Polyacrylamides were found to cause flocculation of a carbon black coating system. Polysaccharide xanthan gums and guar gums were found to be compatible and effective in chromic acid/carbon coating systems. Rhodopal 23 (a tradename for a xanthan gum available from R. T. Vanderbilt of Norwalk, Conn.) was found to be an effective thickener in acid, black no-rinse systems. In addition, a synergy was discovered between Rhodopal and Veegum® magnesium aluminum silicate (a mineral dispersant available from R. T. Vanderbilt Corp. of Norwalk, Conn.) which resulted in a high viscosity at low concentration in acid conditions. However, at low solids concentration the strong flocculation characteristics of Veegum can result in carbon destabilization and cracking in the dried film. Therefore Rhodopol alone is the preferred thickener.

For economies in shipping and handling, the coating composition of the present invention is preferably supplied commercially as a concentrated solution. It was found that the increased concentration of thickening agents in a concentrated coating solution could adversely affect the stability of the carbon black dispersion. For this reason, the coating composition of the present invention, when supplied as a concentrate, is preferably supplied in two parts. The first part being a concentrate of chromic acid coating solution absent thickening agents and the second part, thickening agents, carbon black, etc., which can be mixed and combined with the first part prior to use.

The present invention will now be further illustrated by the following examples which are intended solely for the purpose of illustration and are not to be regarded as limited the scope of the invention or the manner in which it is practiced.

Initial testing was undertaken with "high solids" black no-rinse formulations to establish comparative performance of the black no-rinse coating to Kromtec 690 films. Kromtec 690 is a commercial aluminum conversion coating treatment comprising hexavalent chromium, trivalent chromium and polymer available from Betz Labs, Inc., of Trevose, Pa. The black no-rinse formulations tested were based on chromic acid or Kromtec 690, carbon black, and a styrene acrylate latex emulsion (Synthemul® 40-430 a styrene-acrylic copolymer synthetic resin emulsion available from Reichold Chemicals Inc., of Dover Del.).

| | BNR-1 | BNR-2 | Kromtec 690 |
|---|---|---|---|
| Deionized water | 73.90 | 76.98 | — |
| Synthemul 40-430 | 19.90 | 19.90 | — |
| Carbon Black (as C) | 2.80 | 2.80 | — |
| Kromtex 690 | 3.40 | — | 6.0% (V/V) |
| Chromic Acid 100% | — | 0.32 | — |

(all concentrations are in weight percent unless otherwise noted)

The testing comprised cleaning an aluminum surface with a commercial cleaner to a water break free condition, water rinsing for 20 seconds at ambient temperatures, treatment with BNR-1, BNR-2 or Kromtec 690 and oven drying for 15 minutes at 250° F. The treatment material was exposed to acetic acid salt spray and neutral salt spray in accordance with ASTM B287 and B117-61.

The results indicated that the black no-rinse coating on aluminum surfaces was comparable to Kromtec 690 with respect to acetic acid salt spray and neutral salt spray corrosion resistance.

On an equivalent total chromium basis, hexavalent chromium was preferred over Kromtec 690 even though both were effective in the black no-rinse with respect to corrosion performance.

Testing was then undertaken to develop a low solids black no-rinse. At low solids conditions problems of poor wetting, poor surface coverage etc. are more prevalent. In addition other problems such as marginal bath stability and poor film forming become more apparent. Thus, at low solids conditions surfactants or dispersants, coalescents, and thickening agents become desirable.

A variety of potential low solids, black no-rinse formulations were prepared and examined for overnight stability, film build and film continuity. Many were rejected for failing to meet one or more of these criteria. The most promising were selected for acetic acid and neutral salt spray testing. Table I summarized the formulations evaluated and Table 2 the Corrosion Test results.

TABLE I

| | BLACK NO-RINSE FORMULATIONS | | | | | | | | | | |
|---|---|---|---|---|---|---|---|---|---|---|---|
| | 1 | 2 | 3 | 4 | 5 | 6 | 7 | 8 | 9 | 10 | 11 |
| DI Water | 90.62 | 90.57 | 90.62 | 89.62 | 89.42 | 82.62 | 89.62 | 88.62 | 89.62 | 89.32 | 89.12 |
| Rhodopal 23 | 0.18 | 0.18 | 0.18 | 0.18 | 0.18 | 0.18 | 0.18 | 0.18 | 0.18 | 0.18 | 0.18 |
| Synth. 40422 | 6.00 | 6.00 | — | 4.00 | 4.00 | 8.00 | 4.00 | 4.00 | 6.00 | 6.00 | 6.00 |
| Synth. 40430 | — | — | 6.00 | — | — | — | — | — | — | — | — |
| Rhoplex AC73 | — | — | — | 3.00 | 3.00 | 6.00 | — | 3.00 | — | — | — |
| Rhoplex AC1803 | — | — | — | — | — | — | 3.00 | — | — | — | — |
| Aquablak | 1.80 | 1.80 | 1.80 | 1.80 | 1.80 | 1.80 | 1.80 | 1.80 | 1.80 | 1.80 | 1.80 |
| Triton CF54 | 0.20 | 0.20 | 0.20 | 0.20 | 0.20 | 0.20 | 0.20 | 0.20 | 0.20 | 0.20 | 0.20 |
| Surfonic N95 | 0.10 | 0.10 | 0.10 | 0.10 | 0.10 | 0.10 | 0.10 | 0.10 | 0.10 | 0.10 | 0.10 |
| Texanol | — | — | — | — | 0.20 | — | — | — | — | — | — |
| M-pyrol | 1.00 | 1.00 | 1.00 | 1.00 | 1.00 | 1.00 | 1.00 | 1.00 | 1.00 | 1.00 | 1.00 |
| BYK 301 | — | — | — | — | — | — | — | — | — | 0.30 | 0.30 |
| COAG 130 | — | — | — | — | — | — | — | 1.00 | 1.00 | 1.00 | 1.00 |
| 75% Phos. acid | — | — | — | — | — | — | — | — | — | — | 0.20 |
| Chromic acid | 0.10 | 0.15 | 0.10 | 0.10 | 0.10 | 0.10 | 0.10 | 0.10 | 0.10 | 0.10 | 0.10 |
| Dry Temp F. | 230 | 230 | 230 | 230 | 230 | 230 | 230 | 230 | 230 | 230 | 230 |
| Bath Stability | S | S | S | S | S | S | S | S | S | S | S |

Note:
S = STABLE
Synth. = abbreviation for Synthemul, a Reichhold tradename for resins.
(all concentrations are in weight percent)

Rhoplex AC73 is a polyacrylic emulsion available from Rohm & Haas of Philadelphia, Pa. Rhoplex AC1803 is a hydroxy functional acrylic emulsion available from Rohm & Haas. Aquablak is a carbon black dispersion available from Columbian Chemicals of Cranbury, N.J. Triton CF54 (a surfactant) is a modified polyethoxy adduct available from Rohm & Haas of Philadelphia, Pa. Surfonic N95 (a surfactant) is an ethoxylated nonyl phenol available from Jefferson Chemical Company of Bellaire, Tex. M-Pyrol is N-methyl-2-pyrolidone available from BASF of Parsippany, N.J. Coag 130 is an acrylic acid/polyethyleneglycol allyl ether copolymer available from Betz Laboratories of Trevose, Pa.

TABLE II

| | CORROSION RESULTS | | | | | |
|---|---|---|---|---|---|---|
| | Acetic Acid Salt Spray* HOURS | | | | Neutral SS* HOURS | Film Build |
| Formula | 168 | 260 | 336 | 1000 | 1000 | (mils) |
| 1 | 9 | 9 | 4 | 4 | 10 | 0.10–0.15 |
| 2 | 9 | 9 | 5 | 4 | 10 | 0.10–0.15 |
| 3 | 8 | 5 | 4 | 4 | 10 | 0.10–0.15 |
| 4 | 8 | 4 | 2 | 2 | 10 | 0.10–0.15 |
| 5 | 7 | 4 | 4 | 2 | 10 | 0.10–0.15 |
| 6 | 8 | 4 | 2 | 2 | 10 | 0.10–0.15 |
| 7 | 8 | 4 | 4 | 2 | 10 | 0.10–0.15 |
| 8 | 8 | 8 | 4 | 2 | 10 | 0.10–0.15 |
| 9 | 9 | 8 | 4 | 2 | 10 | 0.10–0.15 |
| 10 | 9 | 9 | 7 | 4 | 10 | 0.10–0.15 |
| 11 | 9 | 8 | 6 | 4 | 10 | 0.10–0.15 |

*Tested according to ASTM B287-94 and rated according to ASTM D714-56 and Table III below
**Tested and rated according to ASTM D1659-59T Method B

TABLE III

| ACETIC ACID SALT SPRAY RATING | |
|---|---|
| Numerical Rating | Blistering of Paint, D714-56 |
| 10 | None |
| 9 | No Photo-Pinpoint to slight |
| 8 | Size 8 Few |
| 7 | Size 6 Few |
| 6 | Size 4 Few |
| 5 | Size 8 Medium |
| 4 | Size 2 Few<br>Size 6 Medium |
| 3 | Size 2 to Medium |
| 2 | Size 4 Medium-Dense<br>Size 6 to 8 Medium-Dense to Dense |
| 1 | Size 2 Medium-Dense to Dense<br>Size 4 Dense |

TABLE III-continued

| ACETIC ACID SALT SPRAY RATING | |
|---|---|
| Numerical Rating | Blistering of Paint, D714-56 |
| 0 | Complete Failure |

From Tables I and II it can be seen that Neutral salt spray results were excellent for all of the formulations screened. Acetic acid salt spray were acceptable at 260 hours. The addition of Coag 130 (an acrylic acid/-polyethylene glycol allyl ether available from Betz Labs, Inc. of Trevose, Pa.) did not affect the performance of the coating. Additions of BYK 301, a dimethyl polysiloxane available from BYK-Chemie USA, Wallingford, Conn. to the bath improves the Acetic Acid Salt Spray performance. Hexavalent chromium levels of 0.1% as chromic acid produces the best results. Bake temperatures did not appear to influence film performance.

While this invention has been described with respect to particular embodiments thereof, it is apparent that numerous other forms and modifications of this invention will be obvious to those skilled in the art. The appended claims and this invention generally should be construed to cover all such obvious forms and modifications which are within the true spirit and scope of the present invention.

What is claimed is:

1. A method of forming a black conversion coating on aluminum or alloys thereof comprising: an aqueous coating the surface with a coating solution having a pH below 7 said aqueous coating solution consisting essentially of from about 0.01 to about 0.20% wt. hexavalent chromium; from about 2.0 to about 10% wt. modified styrene acrylic resin (as solid); from about 0.5 to about 3.0% wt. carbon black pigment; a thickening agent selected from the group consisting of guar gum and xanthan gum to provide a viscosity of from about 300–700 cps; about 0.3% wt. a nonionic dispersant; and from about 0.02% wt. a slow evaporating coalescent and; drying said coating on said surface without rinsing.

* * * * *